US009035846B2

(12) United States Patent
Liang et al.

(10) Patent No.: US 9,035,846 B2
(45) Date of Patent: May 19, 2015

(54) DISPLAY DEVICE HAVING DIRECTIONAL ANTENNA

(75) Inventors: Jia-Haur Liang, New Taipei (TW); Wen-Ping Yu, New Taipei (TW)

(73) Assignee: AmTRAN TECHNOLOGY CO., LTD, Jhonghe District, New Taipei (TW)

( * ) Notice: Subject to any disclaimer, the term of this patent is extended or adjusted under 35 U.S.C. 154(b) by 386 days.

(21) Appl. No.: 13/225,471

(22) Filed: Sep. 4, 2011

(65) Prior Publication Data

US 2012/0293377 A1 Nov. 22, 2012

(30) Foreign Application Priority Data

May 18, 2011 (TW) ..... 100117413 A

(51) Int. Cl.

| | |
|---|---|
| ***H01Q 21/12*** | (2006.01) |
| ***H01Q 1/24*** | (2006.01) |
| ***H01Q 9/06*** | (2006.01) |
| ***H01Q 9/28*** | (2006.01) |
| ***H01Q 19/10*** | (2006.01) |
| ***H01Q 19/28*** | (2006.01) |
| ***H01Q 21/30*** | (2006.01) |

(52) U.S. Cl.

CPC ..... *H01Q 9/065* (2013.01); *H01Q 9/285* (2013.01); *H01Q 19/108* (2013.01); *H01Q 19/28* (2013.01); *H01Q 21/30* (2013.01)

(58) Field of Classification Search

CPC ..... H01Q 19/30; H01Q 5/49; H01Q 21/24
See application file for complete search history.

(56) References Cited

U.S. PATENT DOCUMENTS

| | | | | |
|---|---|---|---|---|
| 3,710,337 | A | 1/1973 | Grant | |
| 6,839,038 | B2 * | 1/2005 | Weinstein | 343/795 |
| 8,405,569 | B2 * | 3/2013 | Tran et al. | 343/879 |
| 8,432,325 | B2 * | 4/2013 | Qi et al. | 343/702 |
| 8,519,890 | B2 * | 8/2013 | Huang et al. | 343/700 MS |
| 8,558,748 | B2 * | 10/2013 | Chen et al. | 343/815 |
| 2005/0057418 | A1 * | 3/2005 | Knadle et al. | 343/815 |
| 2008/0238808 | A1 | 10/2008 | Arita | |
| 2009/0040119 | A1 * | 2/2009 | Kawasaki et al. | 343/702 |
| 2009/0059836 | A1 * | 3/2009 | Hamilton | 370/313 |
| 2009/0096934 | A1 | 4/2009 | Nakajima | |
| 2009/0179805 | A1 * | 7/2009 | Roy et al. | 343/702 |
| 2011/0037863 | A1 | 2/2011 | Mihota | |
| 2011/0099392 | A1 * | 4/2011 | Conway | 713/300 |
| 2013/0249744 | A1 * | 9/2013 | Jang et al. | 343/702 |

FOREIGN PATENT DOCUMENTS

| | | | |
|---|---|---|---|
| CN | 1691409 | A | 11/2005 |
| EP | 1 215 893 | A1 | 6/2002 |
| GB | 974217 | | 11/1964 |
| TW | 200926506 | | 6/2009 |

* cited by examiner

*Primary Examiner* — Trinh Dinh
(74) *Attorney, Agent, or Firm* — Winston Hsu; Scott Margo

(57) ABSTRACT

A display device includes a display panel and a directional antenna. The directional antenna is disposed behind or under the display panel for radiating or receiving wireless signals. The radiating path of the directional antenna is at a specific angle with respect to a horizontal plane for receiving surrounding wireless signals. Or, the signals radiated from the directional antenna may be reflected or refracted to regions above or in front of the display device by a back-side barrier or penetrate a back-side barrier which does not cause large electromagnetic degradation, thereby receiving wireless signals originated from the front-side or back-side of the display device.

6 Claims, 11 Drawing Sheets

DISPLAY DEVICE HAVING DIRECTIONAL ANTENNA

CROSS REFERENCE TO RELATED APPLICATIONS

This application claims priority from Taiwan 100117413 filed on May 18, 2011, the contents of which are incorporated herein by reference.

BACKGROUND OF THE INVENTION

1. Field of the Invention

The present invention is related to a wireless display device, and more particularly, to a flat panel wireless display device having directional antenna.

2. Description of the Prior Art

As telecommunication medium for entertainment, information, transmitting and receiving news in modern society, televisions (TVs) have become commonplace in homes, businesses and institutions. The installation of traditional cable TVs may be complicated due to the arrangement of coaxial cables or optical fibers. In contrast, wireless TVs capable of receiving multi-media data via built-in antenna have become more and more popular.

In a wireless system, antennas occupy more space than other components. In a traditional display device with wireless antennas (such as TV or notebook computer), metallic omnidirectional embedded antennas are normally disposed inside the side frame of the display device in order to communicate with a nearby access point (AP). However, with rapid shrinkage in device size, there is less room available for traditional embedded antennas since more and more flat panel display devices adopt narrow side frames or no side frame at all.

SUMMARY OF THE INVENTION

The present invention provides a display device including a housing; a display panel in the housing; and a first directional antenna disposed in the housing behind or under the display panel for radiating a wireless signal, wherein a first radiating path of the first directional antenna is at a specific angle with respect to a horizontal plane.

The present invention also provides an electronic device having a directional antenna. The directional antenna includes a substrate; a transmitting element disposed on the substrate along a first direction for transmitting signals; a first radiating element disposed on the substrate along a second direction perpendicular to the first direction for providing a first radiation pattern of a first band and including a first terminal structure on a far side away from the transmitting element and at a first predetermined angle with respect to the second direction; a second radiating element disposed on the substrate along the second direction for providing a second radiation pattern of a second band and for directing the radiation pattern of the first band along the first direction; and a first reflecting element disposed on the substrate along the second direction for reflecting the first radiation pattern of the first band towards the first direction.

The present invention also provides an electronic device including a housing and a first directional antenna. The first directional antenna is disposed in the housing for radiating a wireless signal, wherein a first radiating path of the first directional antenna is at a first specific angle with respect to a horizontal plane, the first directional antenna including a first radiating element and a second radiating element, the first radiating element providing a first radiation pattern of a first band, and the second radiating element providing a second radiation pattern of a second band and reflecting the first radiation pattern of the first band.

These and other objectives of the present invention will no doubt become obvious to those of ordinary skill in the art after reading the following detailed description of the preferred embodiment that is illustrated in the various figures and drawings.

DETAILED DESCRIPTION

Figure 1B:
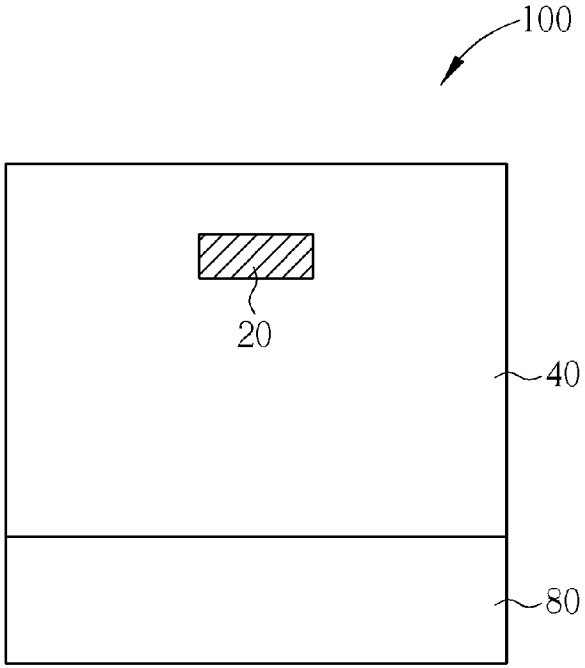
FIG. 1B is a rear-view diagram of the wireless display device according to the first embodiment of the present invention.
Figure 1A:
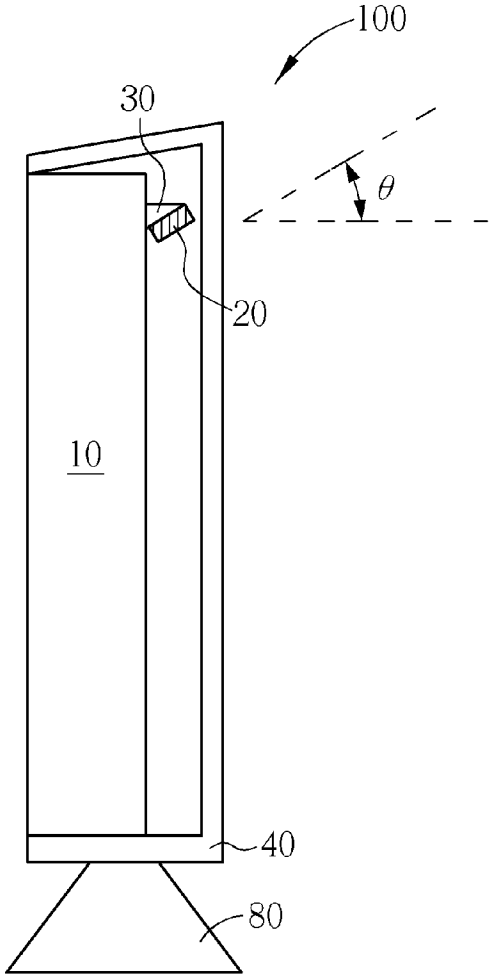
FIG. 1A is a side-view diagram of a wireless display device according to a first embodiment of the present invention.

FIG. 1A is a side-view diagram of a wireless display device 100 according to an embodiment of the present invention. FIG. 1B is a rear-view diagram of the wireless display device 100. The wireless display device 100 includes a display panel 10, a directional multi-frequency antenna 20, a fixture 30, a back housing 40, and a base 80. The fixture 30, to which the directional multi-frequency antenna 20 maybe attached, is disposed on the backside of the display panel 10, so the path of the wireless signals radiated by the directional antenna 20 is at a specific angle θ with respect to the viewing angle (or horizontal plane) of the display panel 10. The back housing 40 may include plastic material for containing and protecting the display panel 10, the directional multi-frequency antenna 20, the fixture 30, or other internal components (not shown) of the wireless display device 100.

Figure 2B:
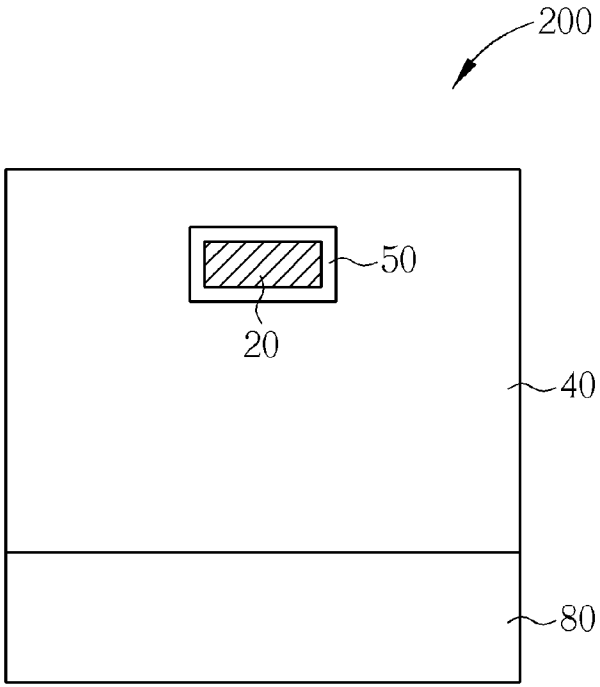
FIG. 2B is a rear-view diagram of the wireless display device according to the second embodiment of the present invention.
Figure 2A:
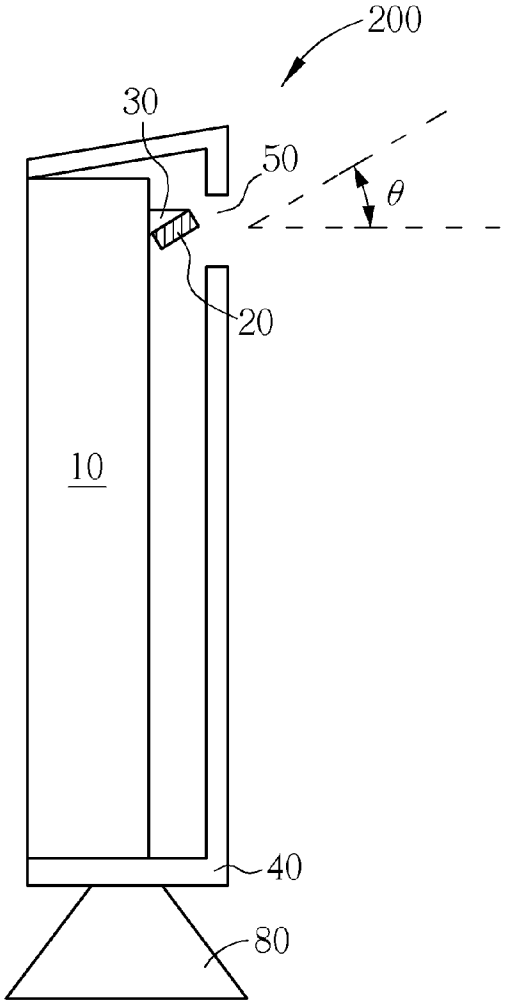
FIG. 2A is a side-view diagram of a wireless display device according to a second embodiment of the present invention.

FIG. 2A is a side-view diagram of a wireless display device 200 according to an embodiment of the present invention. FIG. 2B is a rear-view diagram of the wireless display device 200. Having similar structures, the wireless display device 200 differs from the wireless display device 100 in that the back housing 40 is made of metallic material and includes an opening 50 to allow wireless signals to pass. Therefore, the metallic back housing 40 may protect the display panel 10, the directional multi-frequency antenna 20, the fixture 30, or other internal components (not shown) of the wireless display device 200 without blocking the radiating path of the directional multi-frequency antenna 20.

Figure 3B:
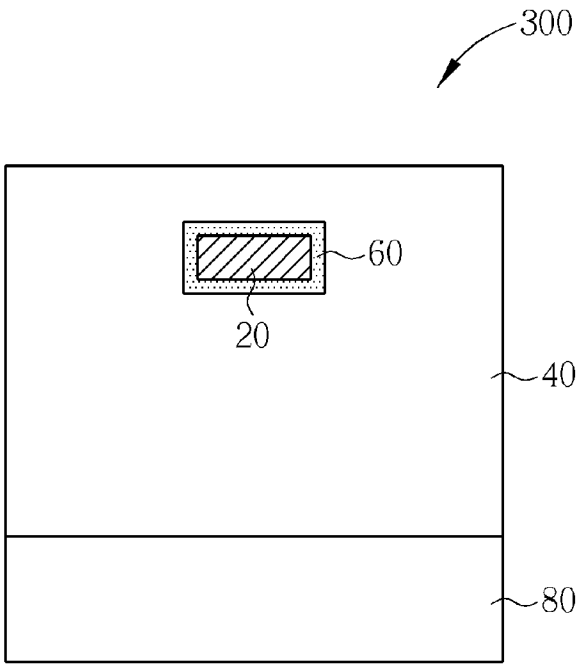
FIG. 3B is a rear-view diagram of the wireless display device according to the third embodiment of the present invention.
Figure 3A:
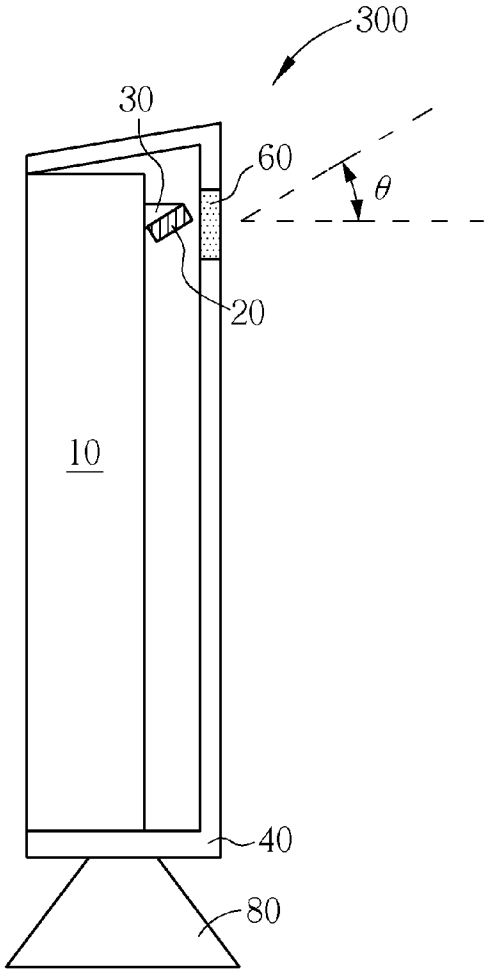
FIG. 3A is a side-view diagram of a wireless display device according to a third embodiment of the present invention.

FIG. 3A is a side-view diagram of a wireless display device 300 according to an embodiment of the present invention. FIG. 3B is a rear-view diagram of the wireless display device 300. Having similar structures, the wireless display device 300 differs from the wireless display device 100 in that the back housing 40 is made of metallic material and includes a plastic cover 60 to allow wireless signals to pass. Therefore, the metallic back housing 40 may protect the display panel 10, the directional multi-frequency antenna 20, the fixture 30, or other internal components (not shown) of the wireless display device 300 without blocking the radiating path of the directional multi-frequency antenna 20.

Figure 4A:
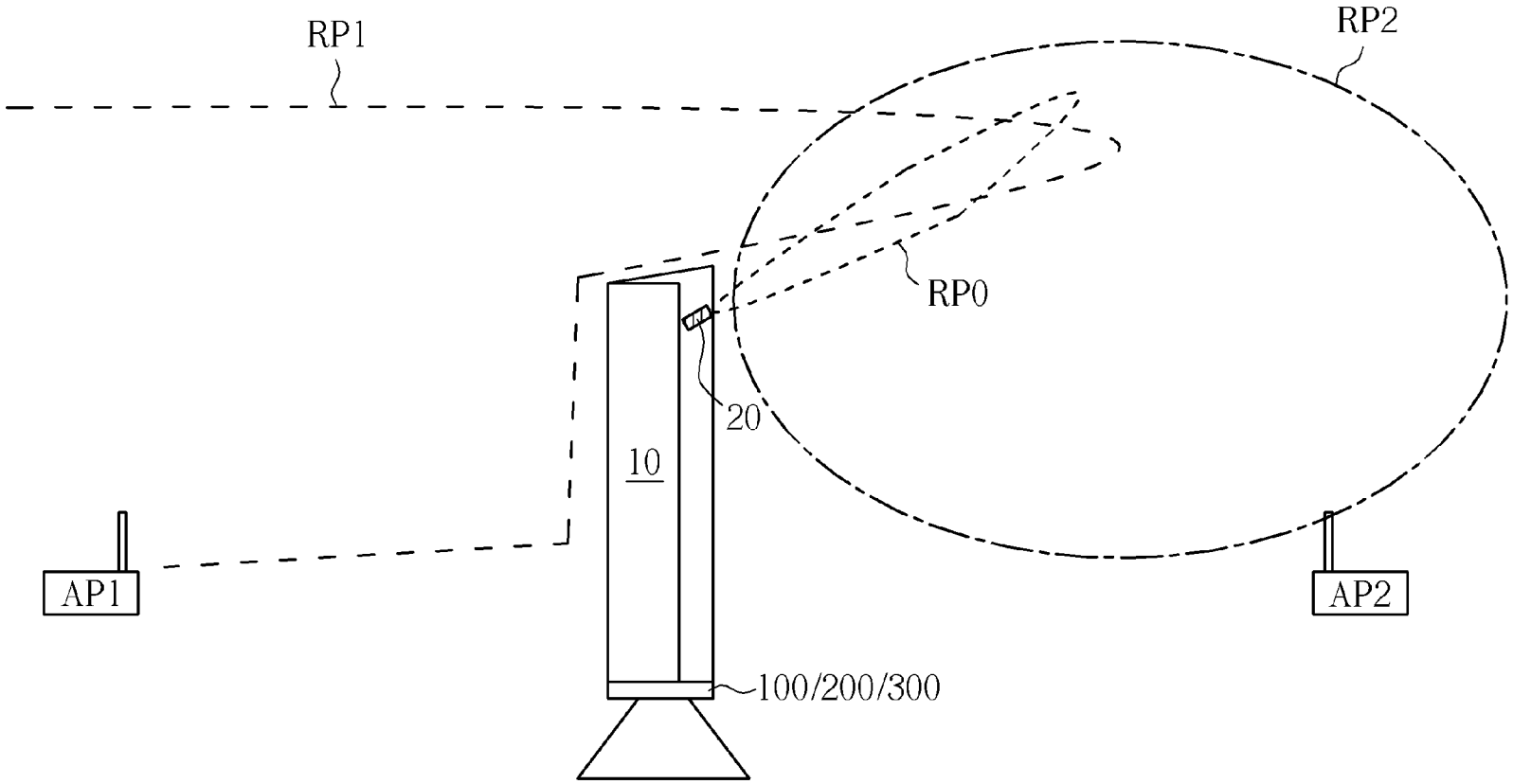
FIGS. 4A and 4B are diagrams illustrating the operation of the wireless display device with various dispositions.
Figure 4B:
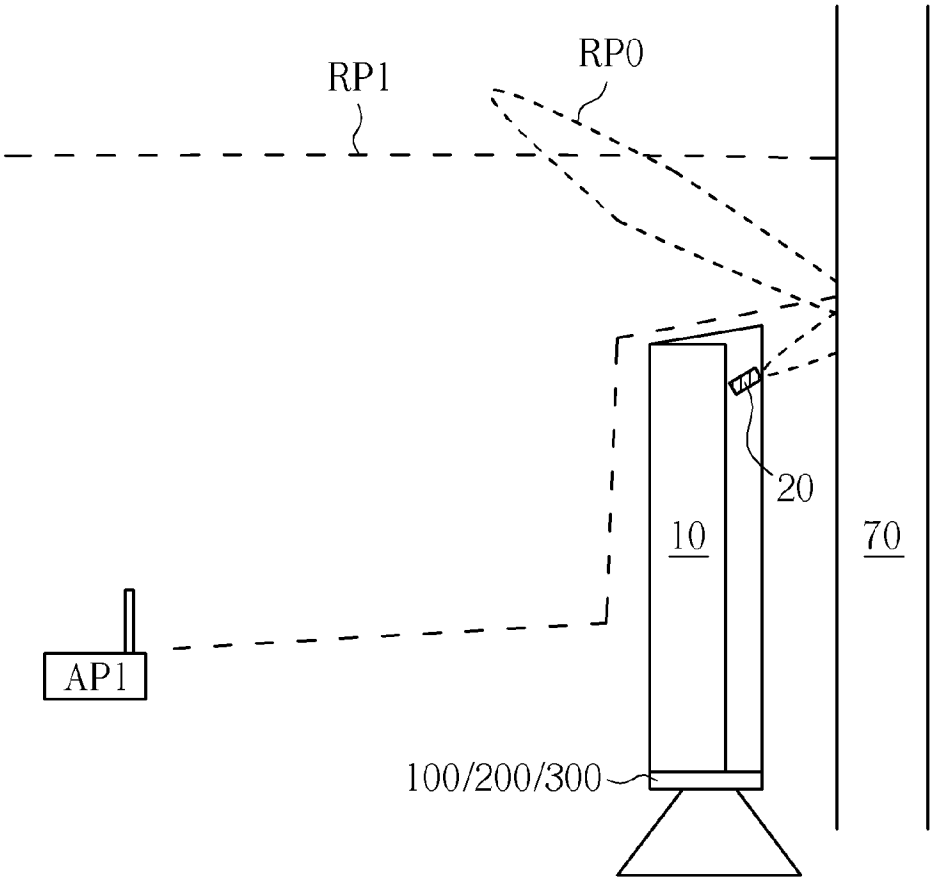

FIGS. 4A and 4B are diagrams illustrating the operation of the wireless display device 100/200/300 with various dispositions according to the present invention. In FIG. 4A, the wireless display device 100/200/300 is disposed in open space, or surrounded by objects which are penetrable by radio signals. An access point AP1 is arranged in front of the wireless display device, while an access point AP2 is arranged behind the wireless display device. The radiation patterns of the wireless display device 100/200/300, the access point AP1 and the access point AP2 are represented by RP0~RP2, respectively. Since the radiating path of the access point AP1 is blocked by the wireless display device 100/200/300, only partial radiation pattern RP1 may arrive to regions above or behind the display device 100/200/300. In one of the embodiments according to the present invention, the radiating path of the directional antenna 20 is at the specific angle θ with respect to the horizontal plane. Therefore, the radiation patterns RP0 and RP1 may intersect each other in regions behind the display device 100/200/300, thereby allowing the display device 100/200/300 to communicate with the access point AP1. Meanwhile, the radiation patterns RP0 and RP2 may also intersect each other in regions behind the display device 100/200/300, thereby allowing the display device 100/200/300 to communicate with the access point AP2.

In FIG. 4B, the wireless display device 100/200/300 is hanged or disposed in front of other structures. In other words, the back of the wireless display device 100/200/300 is adjacent to an object 70 non-penetrable to radio signals. An access point AP1 is arranged in front of the wireless display device. The radiation patterns of the wireless display device 100/200/300 and the access point AP1 are represented by RP0 and RP1, respectively. Since the radiating path of the access point AP1 is blocked by the wireless display device 100/200/300 and the object 70, only partial radiation pattern RP1 may arrive to regions above the display device 100/200/300. In one of the embodiments according to the present invention, the radiating path of the directional antenna 20 is at the specific angle θ with respect to the viewing angle (or horizontal plane) of the display panel 10. Therefore, the radiation pattern RP0 may be reflected or refracted to regions above the display device 100/200/300 and intersect with the radiation pattern RP1, thereby allowing the display device 100/200/300 to communicate with the access point AP1.

Figure 5B:
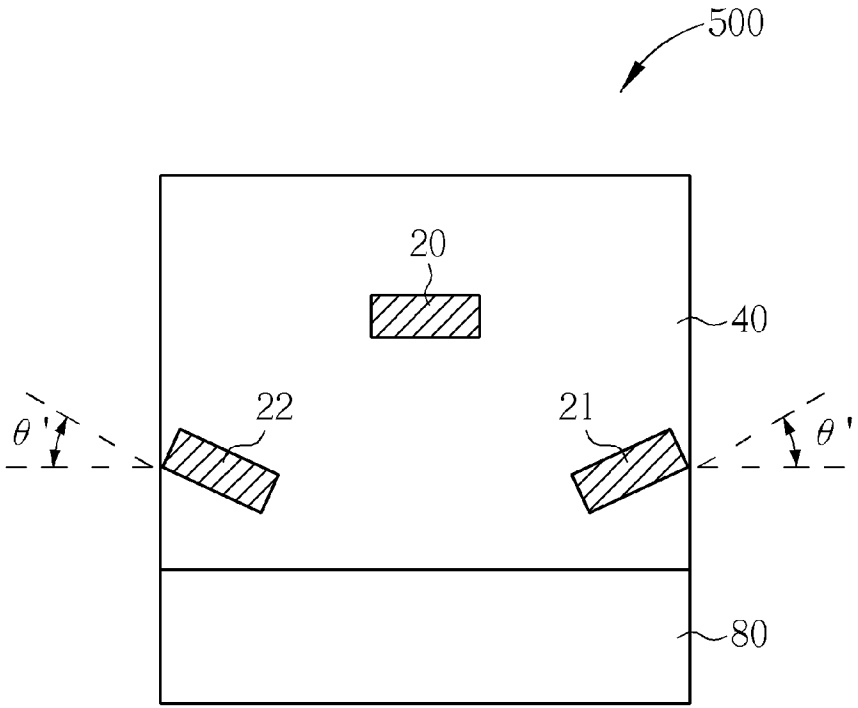
FIG. 5B is a side-view diagram of a wireless display device according to the fifth embodiment of the present invention.
Figure 5A:
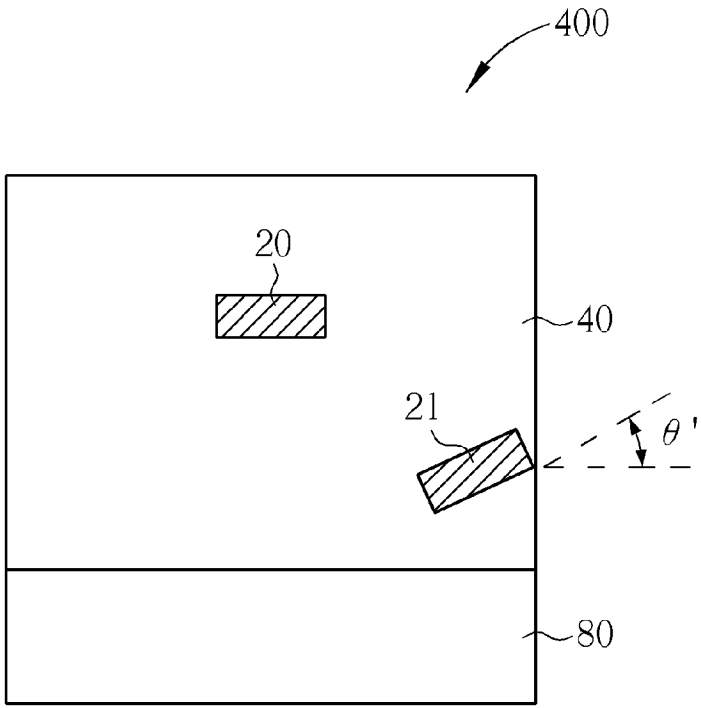
FIG. 5A is a side-view diagram of a wireless display device according to a fourth embodiment of the present invention.

FIG. 5A is a side-view diagram of a wireless display device 400 according to an embodiment of the present invention. FIG. 5B is a side-view diagram of a wireless display device 500 according to an embodiment of the present invention. Having similar structures as the wireless display device 100/200/300, a directional antenna 20 is disposed on the back of the display panel 10 of the wireless display device 400/500, so that the radiating path of the directional antenna 20 is at a specific angle θ with respect to the horizontal plane, as depicted in FIGS. 1A-1B. However, the embodiments of FIGS. 5A and 5B include multiple directional antennas, wherein the wireless display device 400 further includes a directional antenna 21 and the wireless display device 500 further includes two directional antennas 21 and 22. In the wireless display device 400, the directional antenna 21 is disposed on a specific side of the display panel 10 or behind the display panel 10 on a specific side at a specific angle θ' with respect to the horizontal plane, so as to provide a radiation pattern in regions beside the display device 400. The directional antennas 21 and 22 may improve the quality of signal communication. In the wireless display device 500, the directional antennas 21 and 22 are disposed on both sides of the display panel 10 or behind the display panel 10 on both sides at a specific angle θ' with respect to the horizontal plane, so as to provide radiation patterns in regions beside the display device 400. The directional antennas 21~23 may improve the quality of signal communication.

Figure 6B:
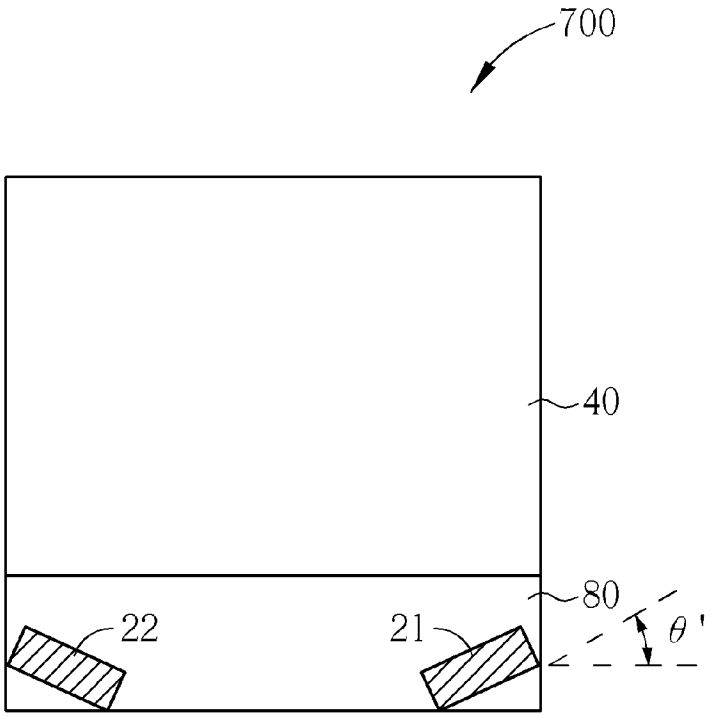
FIG. 6B is a side-view diagram of a wireless display device according to the sixth embodiment of the present invention.
Figure 6A:
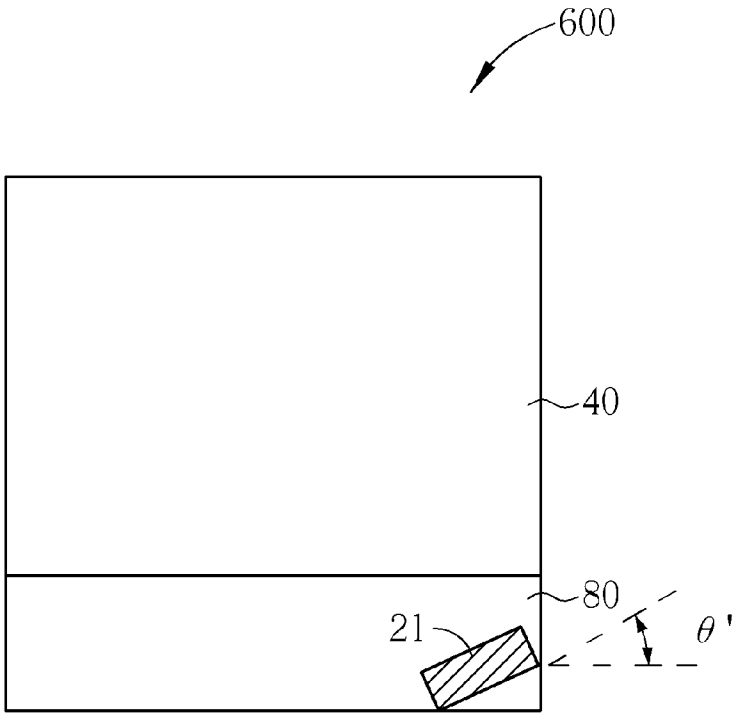
FIG. 6A is a side-view diagram of a wireless display device according to a sixth embodiment of the present invention.

FIG. 6A is a side-view diagram of a wireless display device 600 according to an embodiment of the present invention. FIG. 6B is a side-view diagram of a wireless display device 700 according to an embodiment of the present invention. Similar to the embodiments depicted in FIGS. 1A~3A, the wireless display device 600/700 also includes a display panel (not shown), a fixture (not shown), a back housing 40, and a base 80. However, the wireless display device 600 includes a directional antenna 21, and the wireless display device 700 includes two directional antennas 21 and 22. In the wireless display device 600, the directional antenna 21 is disposed beside the base 80 or behind the base 80 on a specific side at a specific angle θ' with respect to the horizontal plane, so as to provide a radiation pattern in regions beside the wireless display device 600. In the wireless display device 700, the directional antennas 21 and 22 are disposed on both sides of the base 80 or behind the base 80 on both sides at a specific angle θ' with respect to the horizontal plane, so as to provide radiation patterns in regions beside the wireless display device 700. Meanwhile, in an embodiment of the present invention, the directional antenna 21 may also be disposed inside the hanger of the wireless display device, or the base 80 in which the directional antenna 21 is disposed may be stretchable and folded towards the back-side of the wireless display device for serving as the hanger. The directional antenna 21 may still provide a radiation pattern in regions beside the wireless display device.

Figure 7:
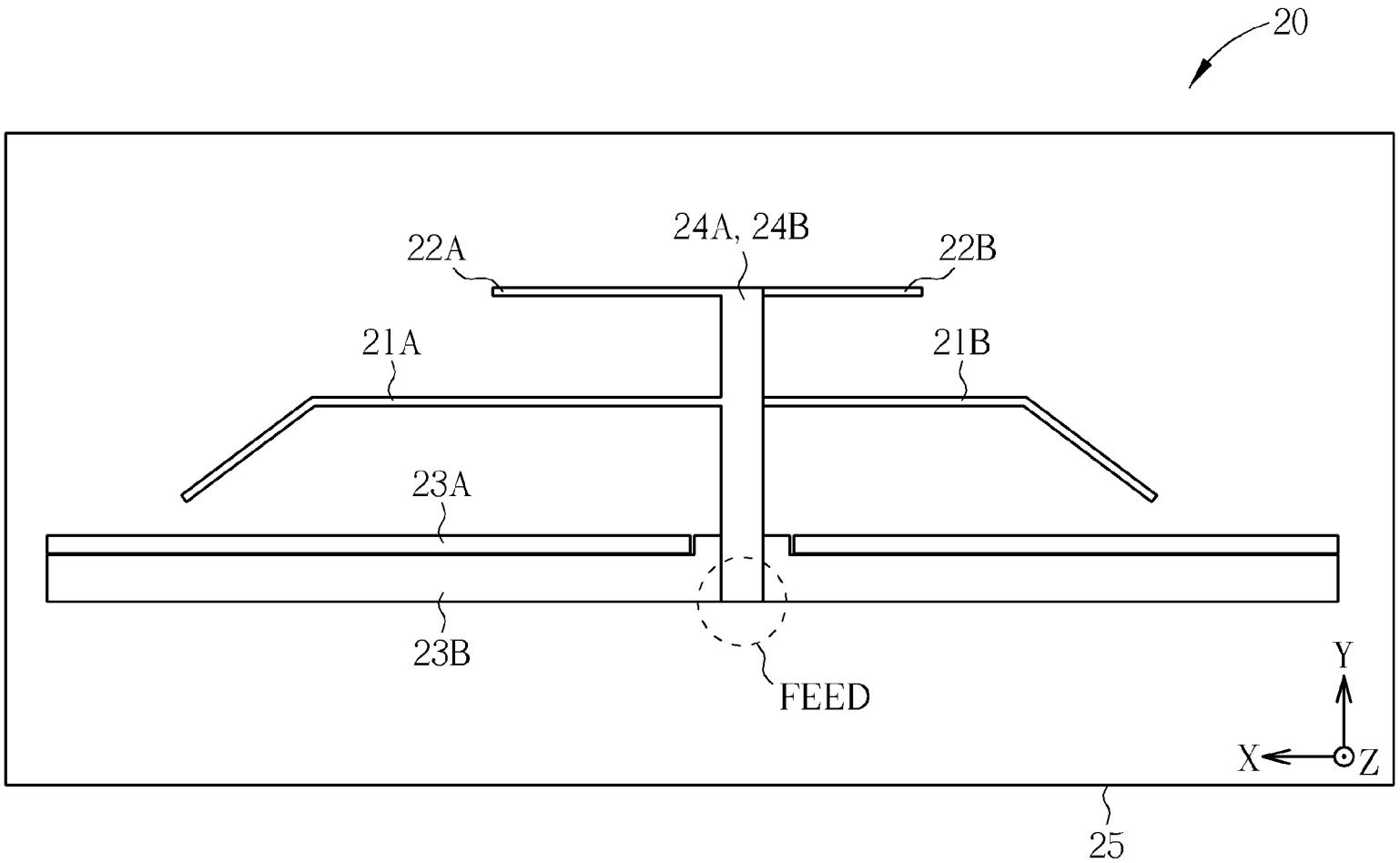
FIGS. 7, 8A, 8B and 9 are diagrams of the directional antenna according to embodiments of the present invention.
Figure 8A:
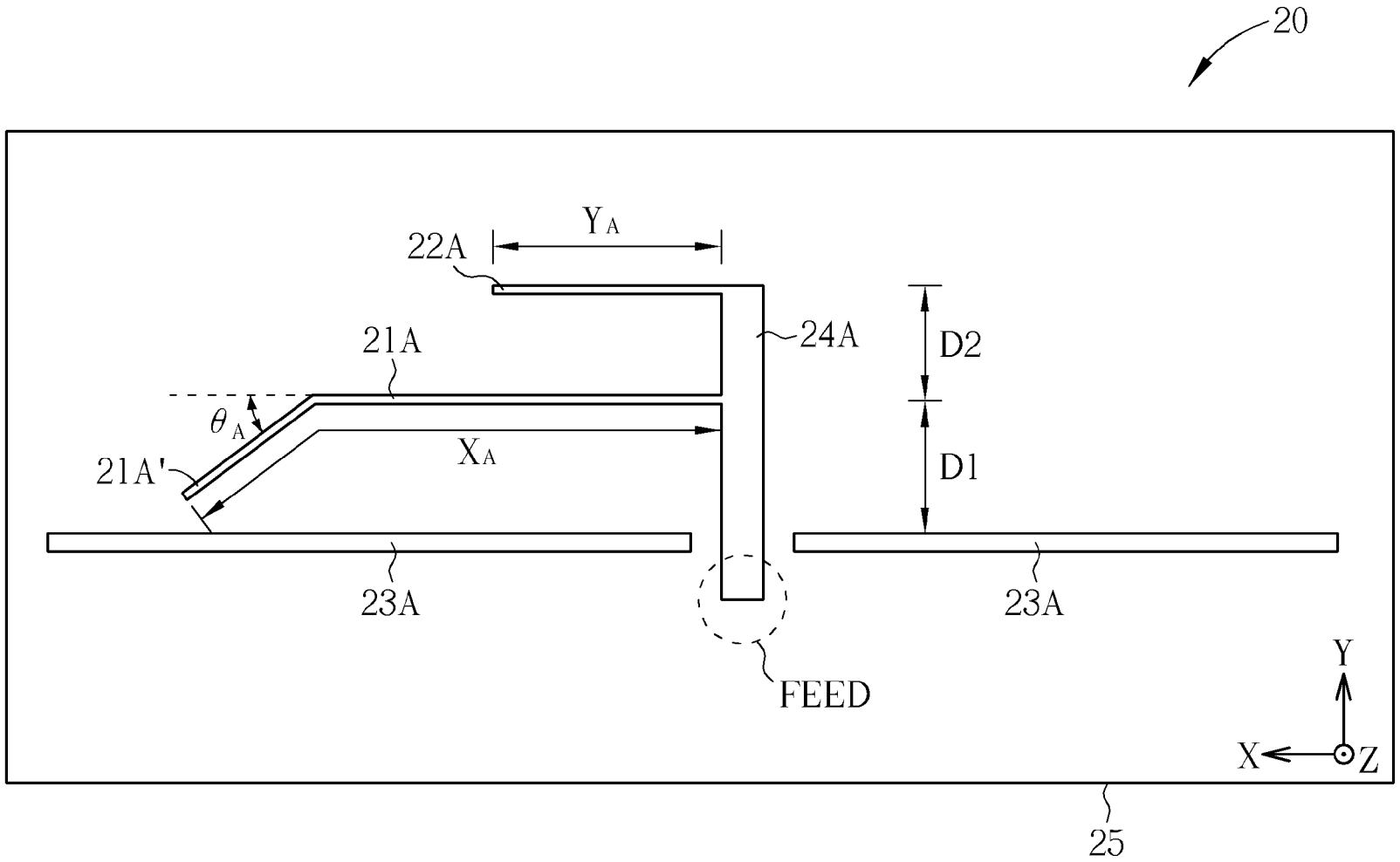
Figure 8B:
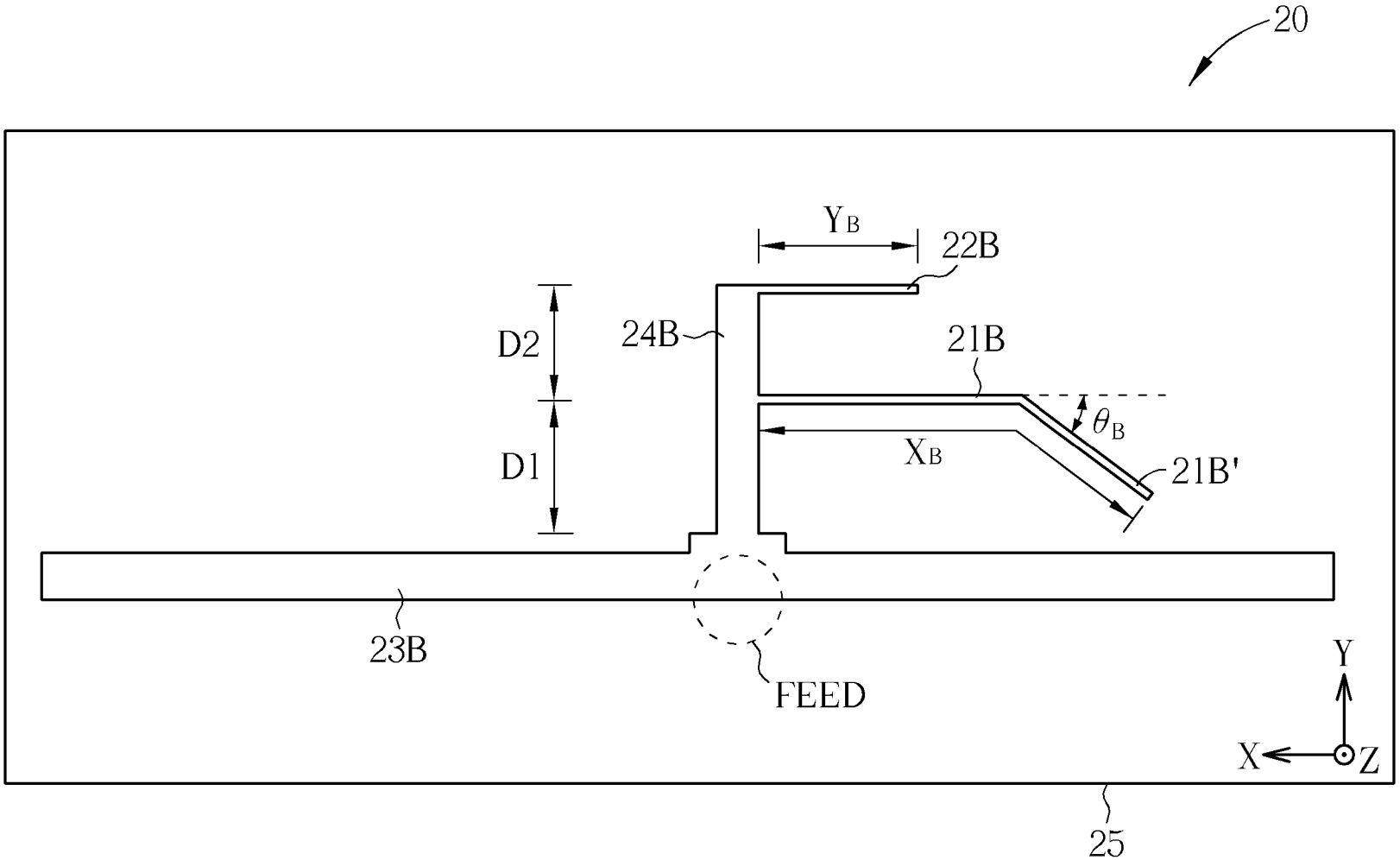

FIGS. 7, 8A and 8B are diagrams of the directional antenna 20 according to an embodiment of the present invention. FIG. 7 is a diagram illustrating the overall structure of the directional antenna 20. FIG. 8A is a diagram illustrating the circuit layout on the top-side of the directional antenna 20. FIG. 8B is a diagram illustrating the circuit layout on the bottom-side of the directional antenna 20. In this embodiment, the directional antenna 20 is a dual-frequency antenna which includes radiating elements 21A, 21B, 22A and 22B, reflecting elements 23A and 23B, transmitting elements 24A and 24B, and a substrate 25. The substrate 25 may be an FR4 double-sided fiberglass having a top circuit layer and a bottom circuit layer. The radiating element 21A, the radiating element 22A, the reflecting element 23A, and the transmitting element 24A are fabricated on the top circuit layer, as depicted in FIG. 8A. The radiating element 21B, the radiating element 22B, the reflecting element 23B, and the transmitting element 24B are fabricated on the bottom circuit layer, as depicted in FIG. 8B. The transmitting elements 24A and 24B are coupled to a signal feed point FEED for transmitting signals to the radiating elements 21A, 21B, 22A and 22B.

$X_A$ represents the length of the radiating element 21A. $X_B$ represents the length of the radiating element 21B. 21A' represents a terminal structure of the radiating element 21A on the far side away from the transmitting element 24A. 21B' represents a terminal structure of the radiating element 21B on the far side away from the transmitting element 24B. The terminal structure 21A' is disposed at a predetermined angle $\theta_A$ with respect to the X-axis, while the terminal structure 21B' is disposed at a predetermined angle $\theta_B$ with respect to the X-axis. The radiating elements 21A and 21B form a double-sided printed dipole antenna which provides a first radiation pattern of a first band (such as 2.4 GHz~2.5 GHZ) having a wavelength $\lambda_1$, wherein $(X_A+X_B)\approx\lambda_1/2$. The reflecting element 23A/23B is configured to reflect the first radiation pattern of the first band along the Y-axis. The distance D1 between the reflecting element 23A/23B and the radiating element 21A/21B is in the range of $0.15\lambda_1$ to $0.25\lambda_1$. The radiating elements 22A and 22B are directors of the radiating elements 21A and 21B and configured to direct the first radiation pattern of the first band along the Y-axis. The distance D2 between the radiating element 21A/21B and the radiating element 22A/22B is in the range of $0.15\lambda_1$ to $0.25\lambda_1$. The radiation patterns of the radiating elements 21A and 21B may have higher directivity by adjusting the predetermined angles $\theta_A$ and $\theta_B$, at which the terminal structures 21A' and 21B' are disposed with respect to the X-axis, respectively. The predetermined angles $\theta_A$ and $\theta_B$ may be between 0~90 degrees.

$Y_A$ represents the length of the radiating element 22A. $Y_B$ represents the length of the radiating element 22B. In addition to functioning as the directors of the radiating elements 21A and 21B, the radiating elements 22A and 22B also form a double-sided printed dipole antenna which provides a second radiation pattern of a second band (such as 5 GHz~6 GHZ) having a wavelength $\lambda_2$, wherein $(Y_A+Y_B)\approx\lambda_2/2$. At this time, the radiating elements 21A and 21B are reflectors of the radiating elements 22A and 22B and configured to reflect the second radiation pattern of the second band along the Y-axis. The distance D1 between the reflecting element 23A/23B and the radiating element 21A/21B is in the range of $0.15\lambda_1$ to $0.25\lambda_1$. The radiating elements 22A and 22B are directors of the radiating elements 21A and 21B and configured to direct the first radiation pattern of the first band along the Y-axis. The distance D2 between the radiating element 21A/21B and the radiating element 22A/22B is in the range of $0.15\lambda_2$ to $0.25\lambda_2$. The radiation patterns of the radiating elements 21A and 21B may have higher directivity by adjusting the predetermined angles $\theta_A$ and $\theta_B$, at which the terminal structures 21A' and 21B' are disposed with respect to the X-axis, respectively. The predetermined angles $\theta_A$ and $\theta_B$ may be between 0~90 degrees.

Figure 9:
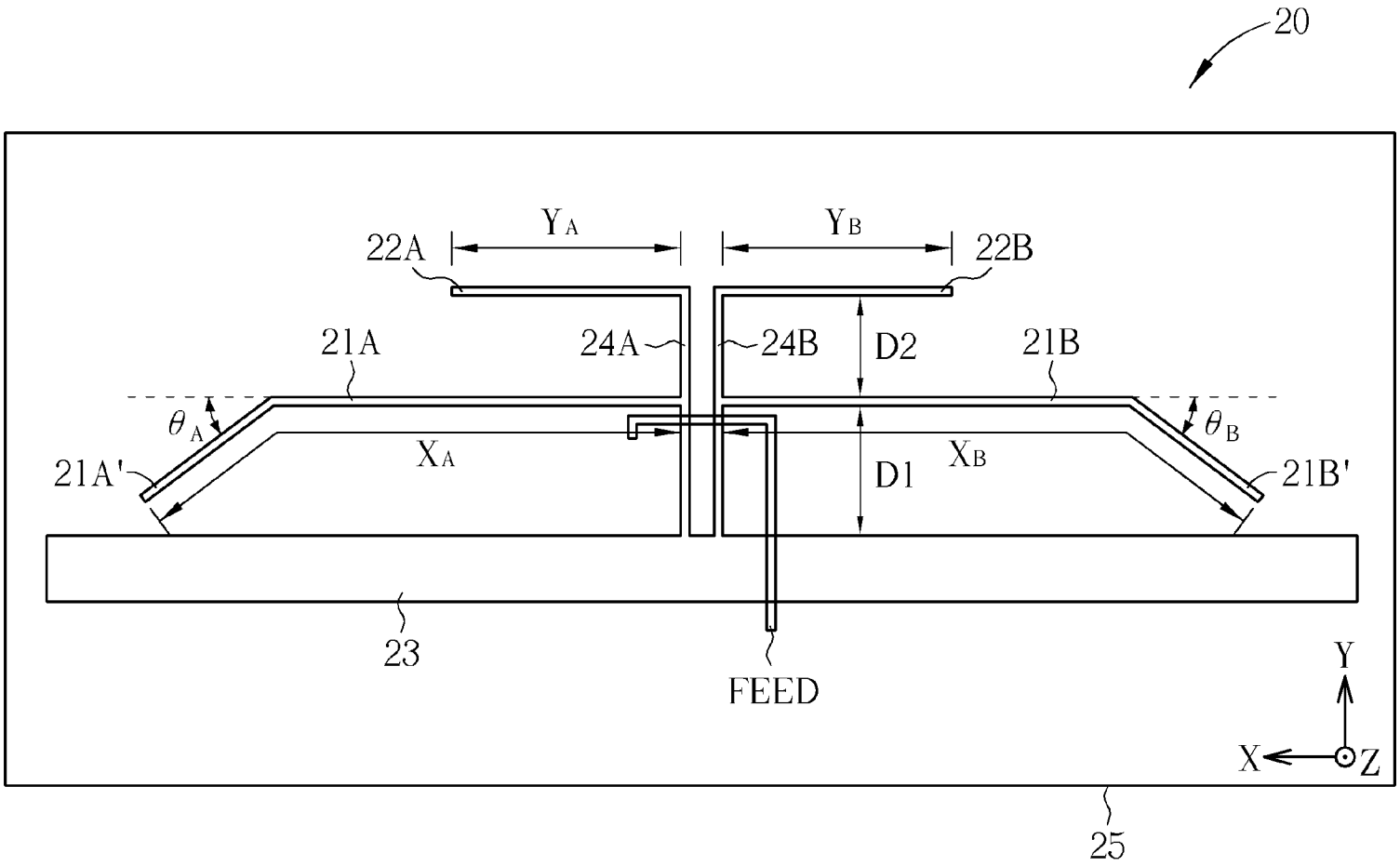

FIG. 9 is a diagram of the directional antenna 20 according to another embodiment of the present invention. In this embodiment, the directional antenna 20 is a dual-frequency antenna which includes radiating elements 21A, 21B, 22A and 22B, a reflecting element 23, transmitting elements 24A and 24B, and a substrate 25. The substrate 25 may be an FR4 double-sided fiberglass having a single circuit layer. The radiating elements 21A, 21B, 22A and 22B, the reflecting element 23, and the transmitting elements 24A and 24B are all fabricated on the same circuit layer. The transmitting elements 24A and 24B are coupled to a signal feed point FEED for transmitting signals to the radiating elements 21A, 21B, 22A and 22B.

$X_A$ represents the length of the radiating element 21A. $X_B$ represents the length of the radiating element 21B. 21A' represents a terminal structure of the radiating element 21A on the far side away from the transmitting element 24A. 21B' represents a terminal structure of the radiating element 21B on the far side away from the transmitting element 24B. The terminal structure 21A' is disposed at a predetermined angle $\theta_A$ with respect to the X-axis, while the terminal structure 21B' is disposed at a predetermined angle $\theta_B$ with respect to the X-axis. The radiating elements 21A and 21B form a single-sided printed dipole antenna which provides a first radiation pattern of a first band (such as 2.4 GHz~2.5 GHZ) having a wavelength $\lambda_1$, wherein $(X_A+X_B)=\lambda_1/2$. The reflecting element 23 is configured to reflect the first radiation pattern of the first band along the Y-axis. The distance D1 between the reflecting element 23 and the radiating element 21A/21B is in the range of $0.15\lambda_1$ to $0.25\lambda_1$. The radiating elements 22A and 22B are directors of the radiating elements 21A and 21B and configured to direct the first radiation pattern of the first band along the Y-axis. The distance D2 between the radiating element 21A/21B and the radiating element 22A/22B is in the range of $0.15\lambda_1$ to $0.25\lambda_1$. The radiation patterns of the radiating elements 21A and 21B may have higher directivity by adjusting the predetermined angles $\theta_A$ and $\theta_B$, at which the terminal structures 21A' and 21B' are disposed with respect to the X-axis, respectively. The predetermined angles $\theta_A$ and $\theta_B$ may be between 0~90 degrees.

$Y_A$ represents the length of the radiating element 22A. $Y_B$ represents the length of the radiating element 22B. In addition to functioning as the directors of the radiating elements 21A and 21B, the radiating elements 22A and 22B also form a single-sided printed dipole antenna which provides a second radiation pattern of a second band (such as 5 GHz~6 GHZ) having a wavelength $\lambda_2$, wherein $(Y_A+Y_B)=\lambda_2/2$. At this time, the radiating elements 21A and 21B are reflectors of the radiating elements 22A and 22B and configured to reflect the second radiation pattern of the second band along the Y-axis. The distance D2 between the radiating element 21A/21B and the radiating element 22A/22B is in the range of $0.15\lambda_2$ to $0.25\lambda_2$.

According to the dielectric constant of the substrate 25 or the signal transmission path, the directional antenna 20 may adopt asymmetric layout ($X_A\neq X_B$ and $Y_A\neq Y_B$, as depicted in FIGS. 7, 8A and 8B) or symmetric layout ($X_A=X_B$ and $Y_A=Y_B$, as depicted in FIG. 9). FIGS. 7, 8A, 8B and 9 are merely embodiments of the present invention and do not limit the scope of the present invention. Meanwhile, the directional antennas 21 and 22 may also adopt the structures depicted in FIGS. 7, 8A, 8B and 9.

The wireless display device of the present invention may be flat panel TVs with narrow side frames or without side frame. One or multiple directional antennas may be disposed at the back of the display panel 10 or the base 80 so that the radiating path of each directional antenna is at a specific angle θ for receiving wireless signals. Or, when disposed in front of a backside object, the wireless signal radiated by each directional antenna may be refracted or reflected to regions above or in front of the display device for communicating with front-side APs. Therefore, the present invention may provide high quality and high efficiency wireless communication when the wireless display device is disposed in open space or in front of a barrier.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device, comprising:

a directional antenna, including:

a substrate being a double-sided substrate including a first metal layer and a second metal layer;

a first transmitting element and a second transmitting element disposed on the substrate along a first direction for transmitting signals;

a first radiating element disposed on the substrate along a second direction perpendicular to the first direction and having a first end connected to the first transmitting element for providing a first radiation pattern of a first band and for reflecting a second radiation pattern of a second band towards the first direction;

a second radiating element disposed on the substrate along the second direction and connected to the second transmitting element for providing the second radiation pattern of the second band and for directing the first radiation pattern of the first band along the first direction;

a first reflecting element disposed on the substrate along the second direction for reflecting the first radiation pattern of the first band towards the first direction;

a second reflecting element disposed on the substrate along the second direction and connected to the second transmitting element for reflecting the radiation pattern of the first band towards the first direction, wherein the first radiating element, the first reflecting element, and the second reflecting element are separate and distinct structures;

a first terminal structure having a first end connected to a second end of the first radiating element, and a second end closer to the first reflecting element than the first end of the first terminal structure, the first radiating element and the first terminal structure forming a first obtuse angle;

a third radiating element disposed on the substrate along the second direction and having a first end connected to the second transmitting element for providing the first radiation pattern of the first band;

a fourth radiating element disposed on the substrate along the second direction and connected to the second transmitting element for providing the second radiation pattern of the second band and for directing the first radiation pattern of the first band along the first direction; and a second terminal structure having a first end connected to a second end of the third radiating element, and a second end closer to the second reflecting element than the first end of the second terminal structure, the third radiating element and the second terminal structure forming a second obtuse angle, wherein the first radiating element, the second radiating element, and the first reflecting element are disposed on the first metal layer of the substrate, and the third radiating element, the fourth radiating element, and the second reflecting element are disposed on the second metal layer of the substrate.

2. The electronic device of claim 1, wherein the first obtuse angle is equal to the second obtuse angle.

3. The electronic device of claim 1, wherein:

a distance between the first and second radiating elements, a distance between the third and fourth radiating elements, a distance between the first radiating element and the first reflecting element, and a distance between the third radiating element and the second reflecting element are between 0.15~0.25 of a wavelength of the first band; and the distance between the first and second radiating elements and the distance between the third and fourth radiating elements are between 0.15~0.25 of a wavelength of the second band.

4. An electronic device, comprising:

a directional antenna deposed in the electronic device, including:

a substrate being a double-sided substrate including a first metal layer and a second metal layer;

a first transmitting element and a second transmitting element disposed on the substrate along a first direction for transmitting signals;

a first radiating element disposed on the substrate along a second direction and including a first end connected to the first transmitting element;

a second radiating element disposed on the substrate along the second direction and connected to the second transmitting element;

a first reflecting element disposed on the substrate along the second direction for reflecting a first radiation pattern provided by the first radiating element;

a second reflecting element disposed on the substrate along the second direction for reflecting a second radiation pattern provided by the second radiating element, wherein the first reflecting element is separate and distinct from the second reflecting element;

a first terminal structure having a first end connected to a second end of the first radiating element, and a second end closer to the first reflecting element than the first end of the first terminal structure, the first radiating element and the first terminal structure forming a first obtuse angle;

a third radiating element disposed on the substrate along the second direction and including a first end connected to the second transmitting element; and a fourth radiating element disposed on the substrate along the second direction and connected to the second transmitting element; and a second terminal structure having a first end connected to a second end of the third radiating element, and a second end closer to the second reflecting element than the first end of the second terminal structure, the third radiating element and the second terminal structure forming a second obtuse angle, wherein the first radiating element, the second radiating element, and the first reflecting element are disposed on the first metal layer of the substrate, and the third radiating element, the fourth radiating element, and the second reflecting element are disposed on the second metal layer of the substrate.

5. The electronic device of claim 4, wherein a distance between the first and second radiating elements, a distance between the third and fourth radiating elements, a distance between the first radiating element and the first reflecting element, and a distance between the third radiating element and the second reflecting element are between 0.15~0.25 of a wavelength of a first band.

6. The electronic device of claim 5, wherein a distance between the first and second radiating elements and the distance between the third and fourth radiating elements are between 0.15~0.25 of a wavelength of a second band.

* * * * *